US006890033B1

(12) United States Patent
Casella

(10) Patent No.: US 6,890,033 B1
(45) Date of Patent: May 10, 2005

(54) BEACH CHAIR FOR USE ON BEACHES AND OTHER LOCATIONS

(76) Inventor: Salvatore Casella, 137-28 95 St., Ozone Park, NY (US) 11417

( * ) Notice: Subject to any disclaimer, the term of this patent is extended or adjusted under 35 U.S.C. 154(b) by 0 days.

(21) Appl. No.: 10/869,537

(22) Filed: Jun. 15, 2004

Related U.S. Application Data

(60) Provisional application No. 60/478,613, filed on Jun. 16, 2003.

(51) Int. Cl.[7] ..... A47C 1/02
(52) U.S. Cl. ..... 297/344.21; 297/35
(58) Field of Search ..... 297/27, 28, 31, 297/35, 40, 344.21, 344.26, 354.13, 359, 297/440.24, 452.2; 248/345.1, 349.1, 408, 248/423, 502, 505

(56) References Cited

U.S. PATENT DOCUMENTS

| | | | | |
|---|---|---|---|---|
| 2,854,065 | A * | 9/1958 | Fox | 248/425 |
| 4,824,170 | A * | 4/1989 | Goldmeier | 297/344.26 |
| 4,842,335 | A * | 6/1989 | Wunderlich | 297/344.21 |
| 5,078,451 | A * | 1/1992 | Sobel | 297/344.26 |
| 5,580,129 | A | 12/1996 | Findlay | |
| 6,048,029 | A | 4/2000 | Percoco | |
| 6,315,360 | B1 | 11/2001 | Guerrini | |
| 6,575,532 | B2 * | 6/2003 | Almerico | 297/344.26 |

* cited by examiner

*Primary Examiner*—Peter M. Cuomo
*Assistant Examiner*—Stephen Vu
(74) *Attorney, Agent, or Firm*—Matthew J. Peirce

(57) ABSTRACT

A beach chair for use on beaches and other locations. The beach chair is capable of rotating on an attachable base. The beach chair, in combination with the attachable base, can be compactly folded up for storage and transportation purposes.

3 Claims, 2 Drawing Sheets

BEACH CHAIR FOR USE ON BEACHES AND OTHER LOCATIONS

I. CROSS-REFERENCE TO RELATED APPLICATIONS

This application claims the benefit of U.S. Provisional Application No. 60/478,613, filed Jun. 16, 2003.

II. BACKGROUND OF THE INVENTION

The present invention concerns that of a new and improved beach chair for use on beaches and other locations.

III. DESCRIPTION OF THE PRIOR ART

U.S. Pat. No. 6,315,360, issued to Guerrini, discloses a beach chair assembly that is capable of rotating.

U.S. Pat. No. 6,048,029, issued to Percoco, discloses a beach chair with a swivel mechanism incorporated and capable of rotating a full 360 degrees.

U.S. Pat. No. 5,580,129, issued to Findlay, discloses a beach chair assembly that is capable of rotating.

IV. SUMMARY OF THE INVENTION

The present invention concerns that of a new and improved beach chair for use on beaches and other locations. The beach chair is capable of rotating on an attachable base. The beach chair, in combination with the attachable base, can be compactly folded up for storage and transportation purposes.

There has thus been outlined, rather broadly, the more important features of a beach chair that the detailed description thereof that follows may be better understood and in order that the present contribution to the art may be better appreciated. There are, of course, additional features of the beach chair that will be described hereinafter and which will form the subject matter of the claims appended hereto.

In this respect, before explaining at least one embodiment of the beach chair in detail, it is to be understood that the beach chair is not limited in its application to the details of construction and to the arrangements of the components set forth in the following description or illustrated in the drawings. The beach chair is capable of other embodiments and being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present beach chair. It is important, therefore, that the claims be regarded as including such equivalent constructions insofar as they do not depart from the spirit and scope of the present invention.

It is therefore an object of the present invention to provide a beach chair which has all of the advantages of the prior art and none of the disadvantages.

It is another object of the present invention to provide a beach chair which may be easily and efficiently manufactured and marketed.

It is another object of the present invention to provide a beach chair which is of durable and reliable construction.

It is yet another object of the present invention to provide a beach chair which is economically affordable and available for relevant market segment of the purchasing public.

Other objects, features and advantages of the present invention will become more readily apparent from the following detailed description of the preferred embodiment when considered with the attached drawings and appended claims.

V. BRIEF DESCRIPTION OF THE DRAWINGS

VI. DESCRIPTION OF THE PREFERRED EMBODIMENT

Figure 1:
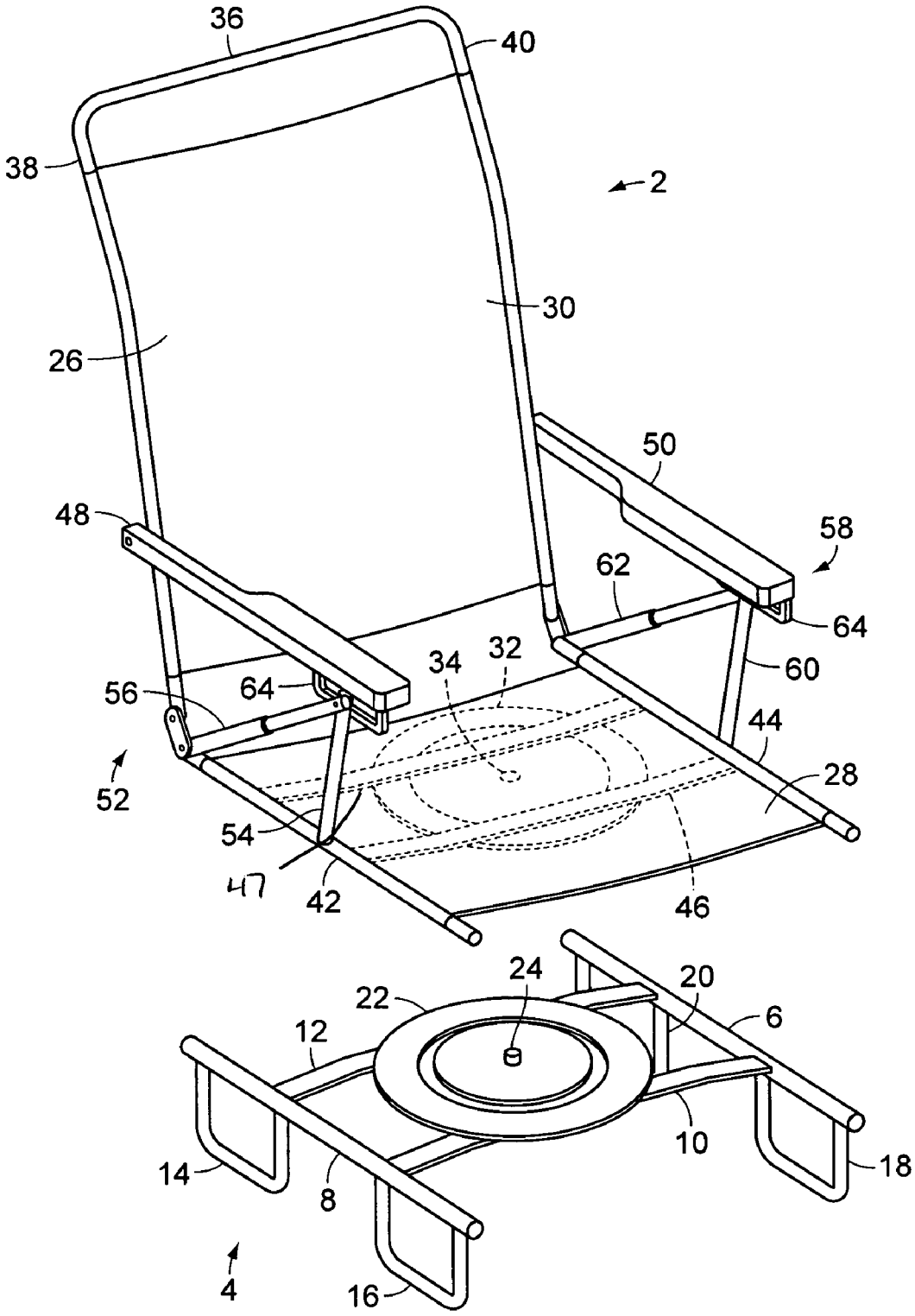
FIG. 1 shows a perspective view of the beach chair and the stand of the present invention.
Figure 2:
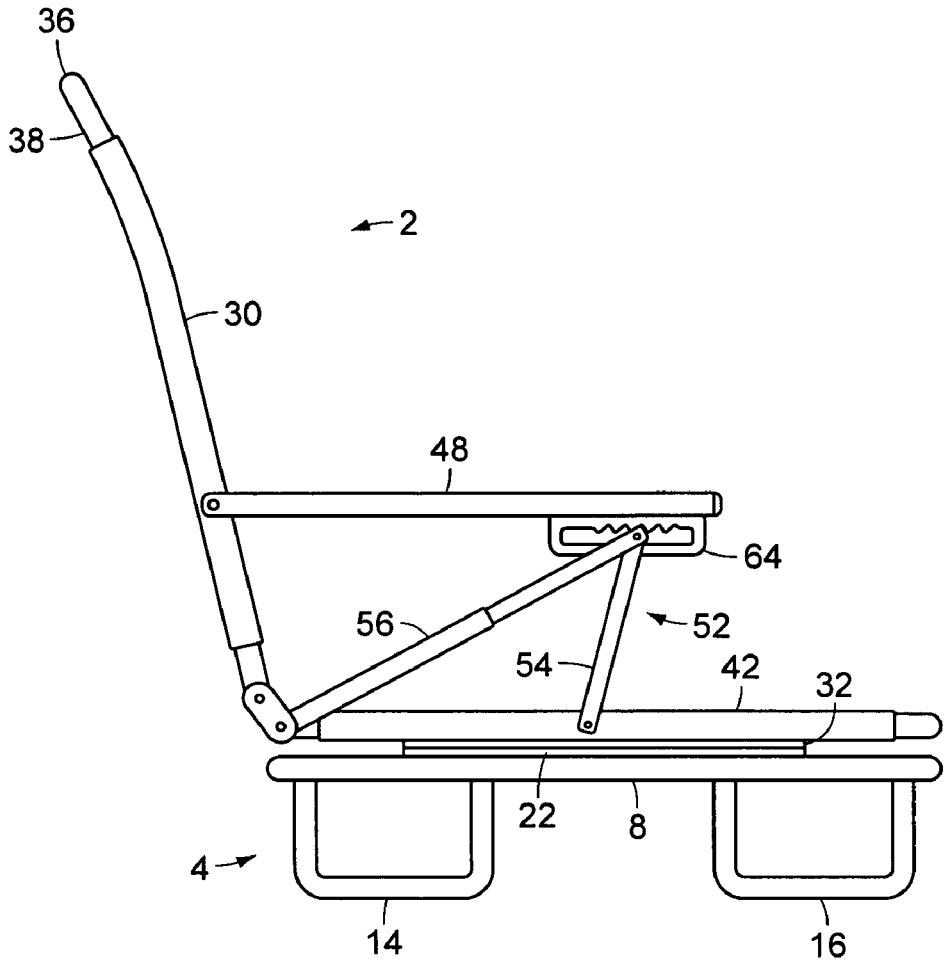
FIG. 2 shows a side view of the beach chair and the stand of the present invention.

FIG. 1 shows a perspective view of the beach chair 2 and the stand 4 of the present invention, while FIG. 2 shows a side view of the beach chair and the stand of the present invention.

Stand 4 has two side bars 6 and 8 with each of the side bars having two ends, a first end and a second end. Side bar 6 is the left side bar, while side bar 8 is the right side bar. Also, stand 4 has two inner bars 10 and 12, with each inner bar having two ends, a left end and a right end. The left end of each inner bar is attached to the side bar 6, while the right end of each inner bar is attached to the side bar 8. Inner bar 10 is located closer to the first end of side bars 6 and 8 than is inner bar 12, which is located to the second end of side bars 6 and 8.

Stand 4 also has four legs 14, 16, 18, 20, with legs 14 and 16 being pivotally attached to side bar 8 and legs 18 and 20 being pivotally attached to side bar 6. Each of the four legs can be folded upward and inward toward the direction of the inner bars 10 and 12, wherever the location of the legs may be. This allows the stand 4 to have a folded-up width no larger than the width of the stand 4 when the legs are deployed.

On top of inner bars 10 and 12 is located swivel stand 22, which is circular and has a central hole 24. Swivel stand 22 is circular and central hole 24 is designed to receive a support pole of a swivel.

Beach chair 2 comprises chair 26, which has two cloth portions consisting of a seat 28 and a backing 30, with the seat 28 having two surfaces, a top surface and a bottom surface. The framework of the chair 26 comprises an upper support bar 36, two upper support poles 38 and 40, a pair of seat support poles 42 and 44, and a pair of front seat support poles 46 and 47, with the bottom surface of the seat 28 resting on the front seat support poles 46 and 47. Each of the parts of the framework of the chair has two ends, a first end and a second end. The first end of the upper support pole 38 is attached to the first end of the upper support bar 36, while the first end of the upper support pole 40 is attached to the second end of the upper support bar 36. The second end of the seat support pole 42 is pivotally attached to the second end of the upper support pole 38, while the second end of the seat support pole 44 is pivotally attached to the second end of the upper support pole 40. The first end of the front seat support pole 46 is attached to the first end of the seat support pole 42, while the second end of the front seat support pole 46 is attached to the first end of the seat support pole 44.

Swivel 32 has two surfaces, a top surface and a bottom surface. The top surface of swivel 32 is the surface that is attached to front seat support poles 46 and 47. The bottom surface of swivel 32 has pole 34, which is placed into central hole 24 on the top of swivel stand 22. When this occurs, the chair can axially rotate about its axis with the swivel stand 22.

Left handle 48 has two ends, a first end and a second end, while right handle 50 has two ends, a first end and a second end. Each of the handles has two surfaces, a top surface and a bottom surface. The first end of left handle 48 is attached to the upper support pole 38, while the first end of right handle 50 is attached to the upper support pole 40. Left support mechanism 52 is comprised of left upper handle support 54 and left lower handle support 56, while right support mechanism 58 is comprised of right upper handle support 60 and right lower handle support 62. Items 54, 56, 60, and 62 each have two ends, a first end and a second end.

The first end of left upper handle support 54 is connected to the pivotal point of the second end of upper support pole 38 and the second end of seat support pole 42. The first end of left lower handle support 56 is attached to seat support pole 42. The second end of both left upper handle support 54 and left lower handle support 56 are connected to adjustable holder 64.

The first end of right upper handle support 60 is connected to the pivotal point of the second end of upper support pole 40 and the second end of seat support pole 44. The first end of right lower handle support 62 is attached to seat support pole 44. The second end of both right upper handle support 60 and right lower handle support 62 are connected to adjustable holder 66.

Figure 3:
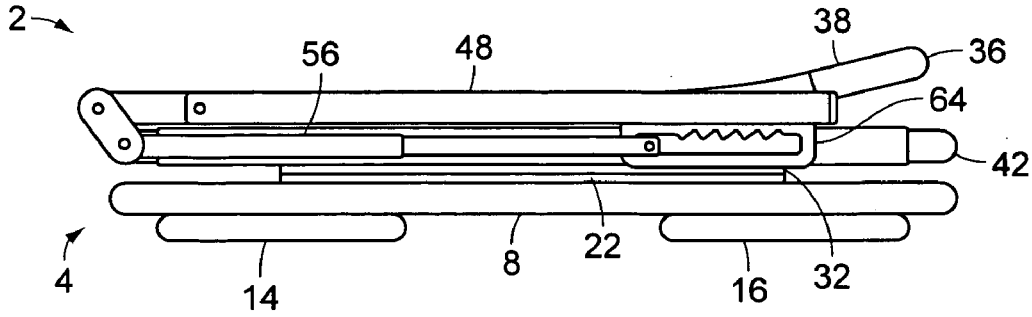
FIG. 3 shows a side view of the beach chair and the stand of the present invention as it would appear after it has been folded up.

FIG. 3 shows a side view of the beach chair 2 and the stand 4 of the present invention as it would appear after it has been folded up.

What is claimed is:

1. A foldable sitting apparatus comprising:

(a) a stand comprising (i) a pair of side bars including a first side bar and a second side bar, each of said side bars having two ends, a first end and a second end, (ii) a pair of inner bars including a first inner bar and a second inner bar, each of said inner bars having two ends, a left end and a right end, (iii) a quartet of legs comprising a first leg, second leg, third leg, and a fourth leg, (iv) wherein the left end of each of said inner bars is attached to the first side bar and the right end of each of said inner bars is attached to the second side bar, (v) further wherein the first leg and the second leg are pivotally attached to the second side bar and the third leg and the fourth leg are pivotally attached to the first side bar, (b) a swivel stand that has two surfaces, a top surface and a bottom surface, the bottom surface of the swivel stand placed on top of the pair of inner bars, the swivel stand having a circular shape, (c) a central hole located on the swivel stand, (d) a beach chair comprising (i) an upper support bar having two ends, a first end and a second end, (ii) a pair of upper support poles comprising a first upper support pole and a second upper support pole, each of the support poles having two ends, a first end and a second end, (iii) a pair of seat support poles comprising a first seat support pole and a second seat support pole, each of the seat support poles having two ends, a first end and a second end, (iv) a pair of front seat support poles comprising a first front seat support pole and a second front seat support pole, each of said poles having two ends, a first end and a second end, (v) wherein the first end of the first upper support pole is attached to the first end of the upper support bar, (vi) further wherein the first end of the second upper support pole is attached to the second end of the upper support bar, (vii) further wherein the second end of the first seat support pole is pivotally attached to the second end of the first upper support pole, (viii) further wherein the second end of the second seat support pole is pivotally attached to the second end of the second upper support pole, (ix) further wherein the first end of each of the front seat support poles is attached to the first end of the first seat support pole, (x) further wherein the second end of each of the front seat support poles is attached to the first end of the second seat support pole, (e) a pair of handles comprising a left handle and a right handle, each of said handles having two ends, a first end and a second end, the first end of the left handle being attached to the first upper support pole, the first end of the right handle being attached to the second upper support pole, (f) a pair of support mechanisms comprising a left support mechanism and a right support mechanism, the left support mechanism connected to the first upper support pole, the second end of the first seat support pole, and the left handle, the right support mechanism connected to the second upper support pole, the second end of the second seat support pole, and the right handle, (g) a pair of adjustable holders comprising a left adjustable holder and a right adjustable holder, the left adjustable holder attached to the bottom surface of the left handle, and the right adjustable holder attached to the bottom surface of the right handle, (h) means for axially placing the beach chair on the swivel stand in order to allow the beach chair to rotate about its connection with the swivel stand, said means further comprising a swivel, the swivel having two surfaces, a top surface and a bottom surface, the bottom surface of the swivel having a central pole, wherein the central pole is placed into the hole located on the top surface of the swivel stand.

2. The foldable sitting apparatus according to claim 1 wherein the left support mechanism further comprises:

(a) a left upper handle support having two ends, a first end and a second end, (b) a left lower handle support having two ends, a first end and a second end, (c) wherein the first end of the left upper handle support is connected to the second end of the first upper support pole and the second end of the first seat support pole, (d) further wherein the first end of the left lower handle support is attached to the first seat support pole, (e) further wherein the second end of the left upper handle support and the second end of the left lower handle support are attached to the left adjustment holder.

3. The foldable sitting apparatus according to claim 1 wherein the left support mechanism further comprises:

(a) a right upper handle support having two ends, a first end and a second end, (b) a right lower handle support having two ends, a first end and a second end, (c) wherein the first end of the right upper handle support is connected to the second end of the second upper support pole and the second end of the second seat support pole, (d) further wherein the first end of the right lower handle support is attached to the second seat support pole, (e) further wherein the second end of the right upper handle support and the second end of the right lower handle support are attached to the right adjustment holder.

* * * * *